US008196553B2

(12) United States Patent
Kline et al.

(10) Patent No.: US 8,196,553 B2
(45) Date of Patent: Jun. 12, 2012

(54) SERIES ELECTRIC-MECHANICAL WATER PUMP SYSTEM FOR ENGINE COOLING

(75) Inventors: Ronald F. Kline, Rochester Hills, MI (US); Kevin J. Laboe, Birmingham, MI (US); Antonio Vespa, Tehachapi, CA (US)

(73) Assignee: Chrysler Group LLC, Auburn Hills, MI (US)

( * ) Notice: Subject to any disclaimer, the term of this patent is extended or adjusted under 35 U.S.C. 154(b) by 309 days.

(21) Appl. No.: 12/361,874

(22) Filed: Jan. 29, 2009

(65) Prior Publication Data

US 2009/0188450 A1 Jul. 30, 2009

Related U.S. Application Data

(60) Provisional application No. 61/024,671, filed on Jan. 30, 2008.

(51) Int. Cl.
*F01P 7/02* (2006.01)

(52) U.S. Cl. ..... 123/41.11; 123/41.01; 123/41.65

(58) Field of Classification Search ..... 123/41.1, 123/41.11, 41.01; 415/112, 180; 417/201, 417/53, 54

See application file for complete search history.

(56) References Cited

U.S. PATENT DOCUMENTS

| | | | | |
|---|---|---|---|---|
| 5,000,143 | A * | 3/1991 | Brown | 123/196 S |
| 5,036,803 | A * | 8/1991 | Nolting et al. | 123/41.1 |
| 6,223,700 | B1 | 5/2001 | Sano et al. | |
| 6,374,780 | B1 | 4/2002 | Rotyna et al. | |
| 6,629,512 | B2 * | 10/2003 | Iwatani et al. | 123/41.14 |
| 6,668,766 | B1 * | 12/2003 | Liederman et al. | 123/41.44 |
| 6,786,183 | B2 * | 9/2004 | Hoelle et al. | 123/41.44 |
| 6,866,092 | B1 * | 3/2005 | Molivadas | 165/104.21 |
| 2001/0029927 | A1 * | 10/2001 | Kato | 123/456 |
| 2002/0005178 | A1 * | 1/2002 | Iwatani et al. | 123/41.14 |
| 2002/0011221 | A1 * | 1/2002 | Suzuki et al. | 123/41.14 |
| 2003/0059310 | A1 * | 3/2003 | Koenig et al. | 417/16 |
| 2004/0173167 | A1 * | 9/2004 | Chanfreau et al. | 123/41.1 |
| 2005/0022769 | A1 * | 2/2005 | Kuze et al. | 123/142.5 R |
| 2006/0000428 | A1 * | 1/2006 | Yamashita et al. | 123/41.14 |
| 2006/0157002 | A1 * | 7/2006 | Pfeffinger et al. | 123/41.29 |
| 2006/0185626 | A1 * | 8/2006 | Allen et al. | 123/41.12 |

* cited by examiner

*Primary Examiner* — Noah Kamen
*Assistant Examiner* — Long T Tran
(74) *Attorney, Agent, or Firm* — Ralph E. Smith

(57) ABSTRACT

A cooling system for an internal combustion engine of a motor vehicle having a rotating member and using coolant in a liquid cooling system, is provided that comprises a radiator for dissipating the heat from the coolant, an electric pump for pumping the coolant through the cooling system, a mechanical pump operatively connected to the rotating member for pumping coolant through the cooling system, and a clutch for disengaging the second pump for minimizing the parasitic loss of the system and improving total fuel economy of the vehicle.

18 Claims, 3 Drawing Sheets

SERIES ELECTRIC-MECHANICAL WATER PUMP SYSTEM FOR ENGINE COOLING

CROSS REFERENCE TO RELATED APPLICATIONS

This application claims the benefit of U.S. Provisional Application 61/024,671 filed Jan. 30, 2008.

FIELD OF THE INVENTION

The present invention relates generally to a cooling system for internal combustion engines. The present invention more particularly relates to an engine cooling system wherein an electric water pump and mechanical water pump are arranged in series for cooling an internal combustion engine.

Cooling systems for internal combustion engines typically contain a mechanical pump that is driven by a rotating member, such as a crankshaft, to pump water through the cooling system, a radiator, a mechanical fan, a thermostat, and a coolant that serves as a medium of heat transfer, such as ethylene glycol and corrosion inhibitors. The coolant circulates through the system to disperse the heat generated by the engine. The thermostat controls the flow of the coolant to the radiator by gradually allowing coolant flow at a predetermined coolant temperature. When the coolant is cold, the thermostat prevents the flow of the coolant through the radiator until the coolant reaches the required predetermined temperature, necessitating the need for the heat to be removed from the engine by the coolant flow to the radiator. The radiator acts as a heat exchanger, whereby the coolant flows through the radiator, releasing heat to the air flowing therethrough, so that the coolant can be recirculated to the engine to absorb more heat, and repeat the process. Irrespective of the coolant temperature, the mechanical pump is designed to operate at full load, pumping the coolant through the cooling system, whether or not the thermostat allows passage of coolant.

BRIEF SUMMARY OF THE INVENTION

The present invention is drawn to a new and improved cooling system for an internal combustion engine of a vehicle comprising an engine, radiator, thermostat, and heater core. When the engine is started cold, the flow of coolant is prevented by the thermostat, until the coolant reaches a predetermined temperature. As the temperature of the engine increases, it directly affects and increases the temperature of the coolant passing through the cooling passages of the engine. Thereafter, the thermostat adjusts, allowing the coolant to flow into the radiator.

The heater control valve, operated by a user in the passenger compartment, allows the flow of hot coolant to the heater core, or alternatively, a plurality of heater cores. The purpose of the heater control valve is to control the flow of coolant into the heater core, allowing the coolant to circulate through the heater core. In a closed position, the heater control valve allows no flow of coolant to the heater core. The lack of flow to the heater core keeps the heater core cool, when heat is not desired in the passenger compartment. On the other hand, when the heater control valve is in the open position, heated coolant is allowed to circulate through the heater core. The heater core is essentially a miniature radiator or heat exchanger, providing heat to the passenger compartment.

The present system comprises an electric pump and a mechanical pump to pump coolant through the cooling system of an internal combustion engine, thus minimizing the parasitic loss of the system and improving the total fuel efficiency of the vehicle. The electric pump and mechanical pump may operate in tandem, or separately, as required to meet engine heat rejection requirements. A clutch is operatively engaged to the mechanical pump and is designed to engage and disengage the mechanical pump. When the clutch is in the off position, the mechanical pump is disengaged from the system. When the system requires, the clutch is switched to the on position, thereby engaging the mechanical pump. Depending upon the position of the clutch, at least one pump is in operation when the internal combustion engine is operating, unless during initial start-up. If the heater control valve is in the open position, as selectively operated by the user in the passenger compartment for the specific purpose of providing heat to the passenger compartment, the coolant flows through the heater core, whereby the heat is removed from the coolant, and the coolant is recirculated through the system.

The thermostat controls the flow of the coolant to the radiator by gradually allowing passage of coolant at a predetermined coolant temperature. When the coolant is cold, the thermostat prevents the flow of the coolant to the radiator until the coolant reaches the required predetermined temperature, necessitating the need for the heat to be removed from the engine by the coolant through the introduction of the coolant to the radiator. The radiator acts as a heat exchanger, whereby the coolant flows through the radiator, releasing heat to the air flowing therethrough, so that the coolant can be recirculated to the engine to absorb more heat, and repeat the process.

The electric pump is intended to provide low engine load coolant flow of the coolant through the cooling system, while the mechanical pump is intended to provide a high engine load coolant flow. In one embodiment, the mechanical pump is fitted with an electric clutch that operatively disconnects the pump impeller and, optional, pump mounting mechanical fan when only low engine load coolant flow, provided by the electric pump, is desired. Advantageously, the use of only the electric pump decreases the parasitic loss as compared to conventional belt driven pump systems. The use of the electric clutch to engage and disengage the pump impeller and, optional, pump mounting mechanical fan, eliminates the high parasitic loss associated with the use of these mechanical devices during typical operation of the internal combustion engine.

In an exemplary embodiment of the present invention, a cooling system for an internal combustion engine having a rotating member and using coolant in a liquid cooling system is provided, including a radiator for dissipating the heat from the coolant, an electric pump for pumping the coolant through the cooling system, a mechanical pump operatively connected to the rotating member for pumping coolant through the cooling system, and a clutch for engaging and disengaging the second pump at a predetermined interval, thus minimizing the parasitic loss of the system by improving total fuel economy of the vehicle.

In another exemplary embodiment of the present invention, a cooling system includes a mechanical fan and/or electric fan that draw air through the radiator to remove heat from the coolant.

In yet another exemplary embodiment of the present invention, the cooling system includes a mechanical fan that is operatively connected to the mechanical pump.

In yet another exemplary embodiment of the present invention, the cooling system includes a thermostat that controls the flow of coolant through the system.

In yet another exemplary embodiment of the present invention, the cooling system includes the mechanical pump in series with the electric pump.

In yet another exemplary embodiment of the present invention, the cooling system includes a three-way valve for directing the flow of coolant in the system.

In yet another exemplary embodiment of the present invention, a cooling system for an internal combustion engine of a motor vehicle having a rotating member and using a coolant in a liquid cooling system is provided, including a radiator for dissipating the heat from the coolant, an electric fan that transfers air through the radiator for transferring the heat from the coolant to the air, an electric pump for pumping the coolant through the cooling system, a mechanical pump in series with the electric pump, wherein the mechanical pump is rotatably engaged to the rotating member for pumping the coolant through the cooling system, and a clutch for engaging and disengaging the mechanical pump at a predetermined interval, thus minimizing parasitic loss of the system by improving total fuel economy of the vehicle.

In yet another exemplary embodiment of the present invention, a cooling system includes a mechanical fan that is operably connected to the mechanical pump, and is engaged and disengaged by the clutch.

In yet another exemplary embodiment of the present invention, a cooling system includes at least one heater core for selectively providing heat to a passenger compartment.

In yet another exemplary embodiment of the present invention, a cooling system includes an engine coolant temperature sensor positioned within a coolant hose after the engine and prior to where the coolant enters the thermostat for measuring the average temperature of the engine.

In yet another exemplary embodiment of the present invention, a cooling system for an internal combustion engine of a motor vehicle having a rotating member and using a coolant in a liquid cooling system is provided, including a radiator for dissipating the heat from the coolant, a mechanical fan that draws air through the radiator for transferring the heat from the coolant to the air; an electric fan that transfers air through the radiator for transferring the heat from the coolant to the air; an electric pump for pumping coolant through the cooling system, a mechanical pump in series with the electric pump, wherein the mechanical pump is rotatably engaged to the rotating member that drives the mechanical pump and pumps coolant through the cooling system, and a clutch for engaging and disengaging the mechanical pump and engaging and disengaging a mechanical fan, thus minimizing the parasitic loss of the system by improving total fuel efficiency of the vehicle, and a three way valve for directing the flow of coolant through the cooling system.

In yet another exemplary embodiment of the present invention, a cooling system includes at least one heater core for selectively providing heat to a passenger compartment.

In yet another exemplary embodiment of the present invention, a cooling system includes a heater shut-off control valve for controlling the flow of coolant.

In yet another exemplary embodiment of the present invention, a cooling system includes the electric pump positioned behind the radiator near the engine.

BRIEF DESCRIPTION OF THE DRAWINGS

The present invention is illustrated and described herein with reference to the various drawings, in which like reference numbers denote like method steps and/or system components, respectively, and in which.

DETAILED DESCRIPTION OF THE INVENTION

Figure 1:
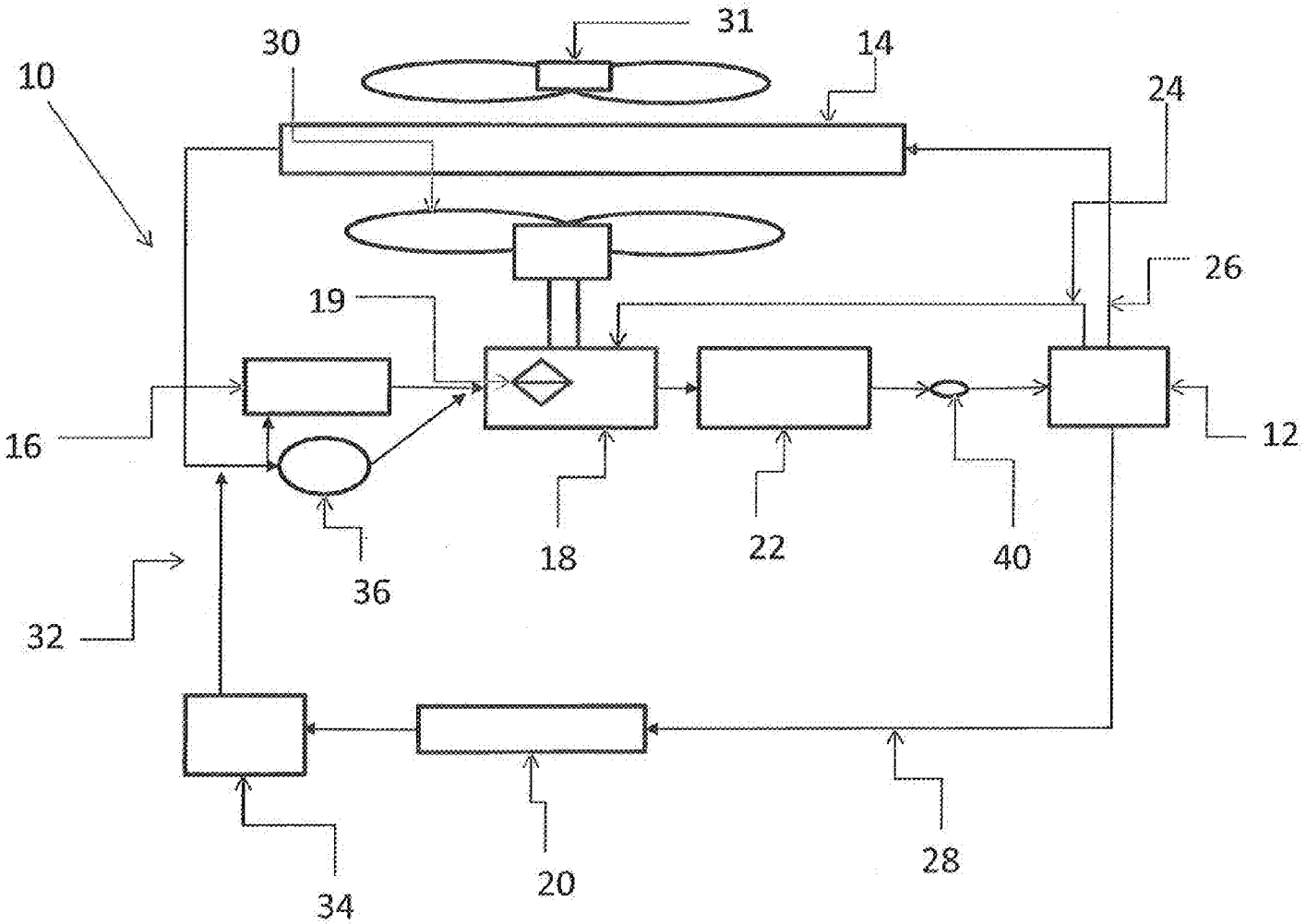
FIG. 1 is a schematic diagram of the cooling system of one preferred embodiment of the invention.

Referring now specifically to the drawings, an exemplary system is illustrated in FIG. 1 and is shown generally at reference numeral 10. FIG. 1 generally depicts the cooling system of an internal combustion vehicle. As illustrated, the system 10 generally comprises a thermostat 12, radiator 14, electric pump 16, mechanical pump 18, heater core 20, and engine 22.

Coolant flow through the system 10 is controlled by the thermostat 12, which is operatively mounted in a coolant flow control junction formed in the engine block (not shown). The thermostat 12 is operatively secured in the flow control junction by thermostat housing that is in turn secured by screws to a mounting pad fastened to or formed on the engine block. The thermostat controls the flow of the coolant through the system 10, and directs the flow of coolant depending upon the temperature of the coolant. The coolant is optionally directed along three ducts, which comprise a bypass hose 24, a supply hose 26, and a heater core supply hose 28. The bypass hose 24 is utilized as a bypass for coolant, preventing the flow of coolant through the radiator 14. The branch hose 24 is typically utilized during the initial start-up of the internal combustion engine 22, when the engine 22 is at a low temperature. The supply hose 26 allows the coolant to flow from the thermostat 12 to the radiator 14, during normal operating conditions after the initial start-up of the internal combustion engine 22. The heater core supply hose 28 supplies coolant to the heater core 20, when heat is desired within the passenger compartment.

The mechanical pump 18 is a pump of a known type, having an impeller that pumps the coolant from the mechanical pump 18 and through the system 10, and powered by a rotating member, such as the crankshaft. The mechanical pump 18 employs the use of an electric clutch 19 for operatively engaging and disengaging the operation of the pump based upon a predetermined set of operational specifications. The mechanical fan 30 is mounted on the mechanical pump 18 and driven by the mechanical pump 18.

The mechanical fan 30 and electric fan 31 aid in the efficiency of the cooling system 10, thereby increasing the amount of heat that is removed from the coolant and transferred to the surrounding air. In the present invention, at high speeds, the outside air driven through the radiator 14 by the vehicle's forward motion is usually sufficient to maintain proper cooling within the system 10, with only the electric fan 31 operational. This arrangement allows the system to have the ability to control the mechanical fan 30 and electric fan 31, and allow the mechanical fan 30 and electric fan 31 combination to provide adequate air flow at all vehicle speeds to meet the engine heat rejection demand. However, at low speeds or idle, when the system 10 needs additional air flow to maintain sufficient cooling, both the mechanical fan 30 and electric fan 31 can be engaged to supply the additional air flow. The mechanical fan 30 and electric fan 31 may have any diameter, pitch, or number of blades to properly cool the system 10 based upon the vehicle's air requirements. In the present invention, the mechanical fan 30 is driven by the mechanical pump 18 via a belt, but an independent electric motor may be utilized to drive the mechanical fan 30, if desired.

The electric clutch 19 within the mechanical pump 18 is designed to operatively engage and disengage the mechanical pump 18. When the system requires, the clutch 19 is engaged, thereby engaging the mechanical pump 18, as required by higher engine speeds and loads. Alternatively, when the mechanical pump 18 is no longer desired or needed by the system 10, the mechanical pump 18 is disengaged from the system 10 by the clutch 19 in the off position. Specifically, the clutch 19 engages and disengages the impeller of the mechanical pump 18, preventing the mechanical pump 18 from pumping coolant through the system 10. In addition thereto, the clutch 19 may optionally control the operation of the mechanical fan 30, engaging and disengaging the mechanical fan 30.

The operation of the clutch 19 is based upon a predetermined set of algorithms used to control the mechanical pump 18. The algorithm inputs relate to the operation of the vehicle, including the engine speed, engine torque, and engine temperature. Based upon the specific algorithm, the clutch 19 engages and disengages the mechanical pump 18.

The electric pump 16 is a pump of a known type. In one embodiment, the electric pump 16 is a 200 Watt pump that is pulse-width-modulated (PWM). The operation of the pump is controlled by a predetermined set of algorithms. The algorithms are based upon the operation of the vehicle that set forth the engine speed, engine torque, engine temperature, and heater flow request.

The radiator is sized to keep the engine at a design temperature under the most extreme conditions in which the vehicle is likely to encounter. The radiator will be typically mounted behind the grill of the vehicle so that outside air may be driven through the radiator by the vehicle's forward motion. However, other placement options may be employed depending upon the placement of the engine within the vehicle. The radiator transfers thermal energy from the coolant to the surrounding air for cooling the coolant, thus cooling the engine. In operation, the coolant absorbs and conducts heat away from the engine and its parts through the cooling passages, and carries the heat to the radiator, thereby transferring the heat to the surrounding air blowing through the radiator.

In operation, when the internal combustion engine 22 is started, coolant enters the mechanical pump 18 from the radiator 14. The coolant is pumped from the mechanical pump 18 and into the cooling passages (not shown) that extend and are distributed throughout the engine 22. At the initial start up, the coolant is absorbing a small amount of heat from the engine 22, so the coolant flows back into the mechanical pump 18 by way of the bypass hose 24, wherein the coolant bypasses the radiator 14. At initial start-up, neither the electric pump nor mechanical pump 30 are in operation. As the engine 22 begins to warm-up, the electric pump is engaged and increases in activity gradually. As the electric pump 16 gradually reaches full operation, the mechanical pump 18 is engaged, whereby the system 10 is operated by the mechanical pump 18 and electric pump 16. The mechanical pump 18 and/or electric pump 16 continue to pump the coolant through the engine 22 while the coolant is redirected to the mechanical pump 24, thereby bypassing the radiator 14, until the coolant reaches a predetermined temperature.

When the coolant reaches a predetermined temperature, the thermostat 12 gradually increases the amount coolant flow, allowing the coolant to flow through the supply hose 26 and into the radiator 14. The thermostat 12 keeps the engine temperature at a predetermined level, wherein the thermostat 12 regulates the flow of coolant through the system 10. The temperature of the coolant is directly related to the temperature of the engine 22, as the engine heats up, so does the coolant. The coolant flows through the engine cooling passages, wherein the heat from the engine 22 is transferred to the coolant that flows to the thermostat 12. Based upon the temperature of the coolant, the thermostat 12 regulates the flow of coolant through the system 10. When the thermostat 12 does not allow coolant through, the coolant enters the bypass hose 24 and is recirculated to the mechanical pump 18, thereby bypassing the radiator 14. When the thermostat 12 gradually allows coolant to pass, the coolant enters the supply hose 12 and flows into the radiator 14 for the transfer of the heat from the coolant, whereby the coolant is cooled and recirculated through the system 10. This particular arrangement allows the engine 22 to heat up quickly to optimal operating conditions and is maintained at those conditions thereafter.

The coolant also flows through the heater core supply hose 28 and into the heater core 20. The heater core 20 is connected to a heating system (not shown) that is operatively mounted within the passenger compartment for conventional heating and window defrosting. The heater core 20 essentially operates like the radiator or a heat exchanger, wherein the heat is removed from the coolant and blown into the passenger compartment of the vehicle when so desired by the passenger. The coolant flows from the heater core 20 by way of a heater core exit hose 32 and into the either the electric pump 16 or mechanical pump 18 for reintroduction into the engine 22. Alternatively, a heater core shutoff valve 34 is positioned on the heater core exit hose 32 for preventing the flow of coolant through the heater core exit hose 32.

As the coolant exits the radiator 14, the coolant enters a check valve 36 or the electric pump 16. The coolant may enter the check valve 36, wherein the coolant may bypass the electric pump 16 and flow directly into the mechanical pump 18. The check valve 36 only allows the flow of coolant in a single direction, which is from the radiator 14 and into the mechanical pump 18, as illustrated in FIG. 1. Preferably, the check valve 36 is a mechanical check valve of a known type. Alternatively, the coolant flows from the radiator 14 and into the electric pump 16, whereby the coolant is pumped to the mechanical pump 18 from the electric pump 16.

Figure 2:
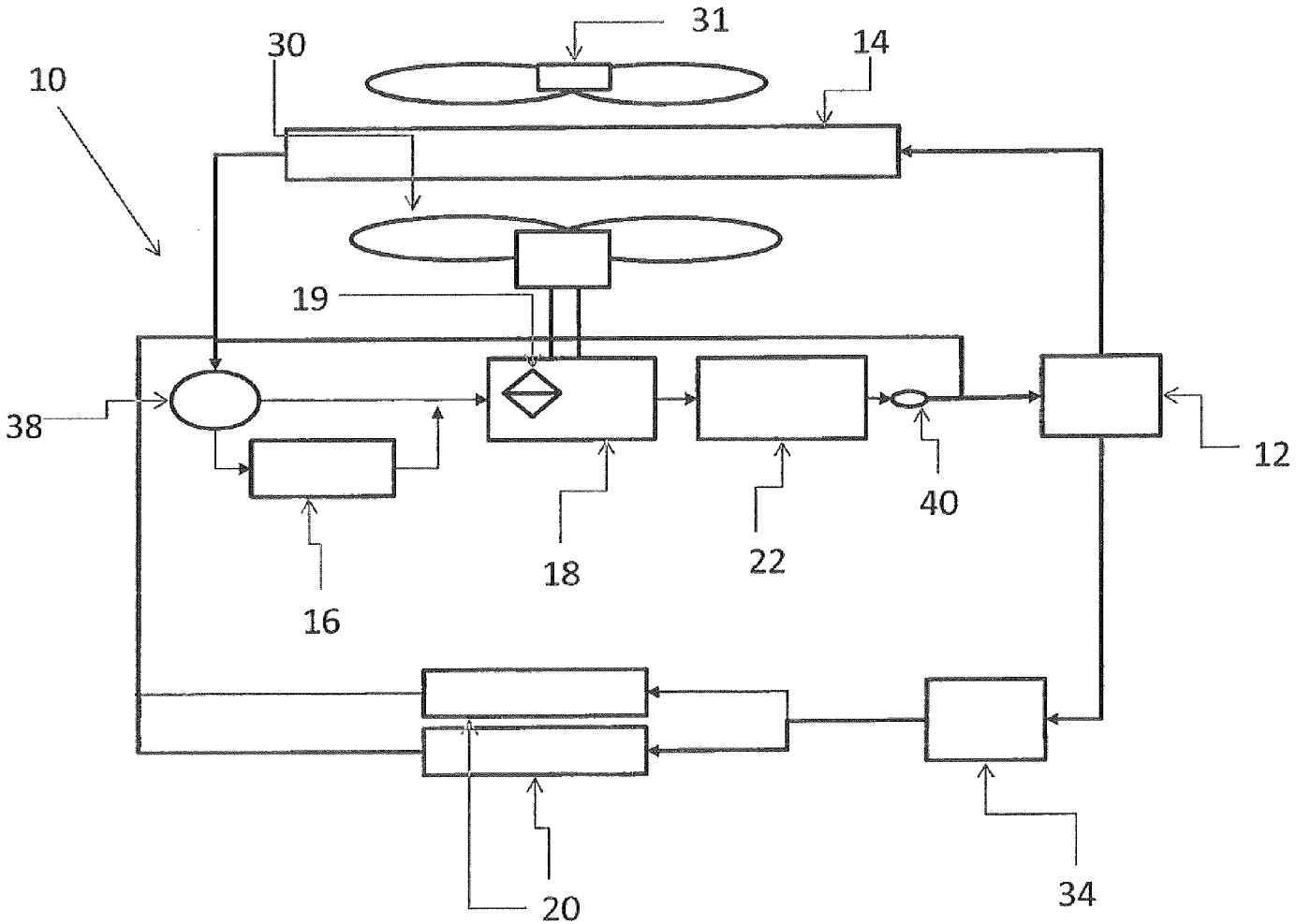
FIG. 2 is a schematic diagram of the cooling system of another preferred embodiment of the invention.

The mechanical pump 18 is mechanically driven by the rotating member and includes a clutch 19 that optionally engages and disengages the mechanical pump 18. In one embodiment, the clutch 19 is an electric on/off clutch 19 that disconnects both the impeller of the mechanical pump 18 and pump mounted mechanical fan 30 from the system 10. The mechanical pump 18 provides for high engine load coolant flow, and allows for coolant to flow through the mechanical pump 18 with the least resistance as possible. When the mechanical pump 18 is disengaged, the coolant flows from the electric pump 16 to the engine 22, during low engine load coolant flow operations. During high engine load coolant flow operations, the clutch 19 engages the mechanical pump 18, whereby the mechanical pump 18 is operational and pumps coolant through the system 10. During high engine load coolant flow operations, the coolant can either flow into the mechanical pump 18 from the check valve 36, the electric pump 16, or both, via a three-way valve 38, as shown in FIG. 2. During high flow operations, the engine temperature is producing a large amount of heat that must be transferred to the coolant quickly and efficiently to prevent damage to the engine 22. The mechanical pump 18, by creating a higher velocity flow of the coolant, pumps more coolant through the cooling passages of the engine 22, dispersing the heat faster than solely using the electric pump 16. While more coolant is flowing through the engine absorbing larger amounts of heat, the heat must be transferred rapidly from the coolant, by way of the radiator 14, and into the surrounding air. To accomplish this task, the mechanical fan 30 is controlled by the clutch 19, meaning when the clutch 19 engages the mechanical pump 18, the mechanical fan 30 is operational along with the impeller of the mechanical pump 18. The mechanical pump 18 is operatively engaged when the need for high coolant flow is desired, such as at higher engine speeds.

When the mechanical pump 18 is disengaged, the electric pump 16 provides low engine load coolant flow through the system 10. This allows for the decrease in parasitic loss typically encountered with a conventional belt driven mechanical pump system. The mechanical pump 18 in a typical belt driven system accounts for a parasitic loss. The parasitic loss is further decreased in the disclosed invention, since the disengagement of the clutch 19 disengages not only the pump impeller, but also the pump mounted mechanical fan 30. Both the mechanical pump 18 and the mechanical fan 30 account for a significant amount of the parasitic loss in a conventional belt driven system. The system 10 is still operational with the disengagement of the mechanical pump 18, because the electric pump 16 pumps an adequate amount of coolant through the system 10, based on the engine heat rejection requirements.

A control module (not shown) is electrically connected to the system 10, and monitors and controls the engine cooling process. The control module communicates with the various subparts of the system 10 through multiple electrical connections (not shown). The electrical connections are of a known type, and are located on the electric pump 16 and mechanical pump 18. The control module can disengage the pump impeller and pump mounted mechanical fan based upon a set of algorithms, by disengaging the clutch 19.

As illustrated in FIG. 2, a three-way valve 38 may be introduced to the system having three ports, wherein the coolant enters one port and is directed to either a second port in one position or the third port in another position. The three-way valve 38 is a more robust method to control coolant flow as compared to a standard check valve. In addition, the three-way valve 38 can prevent the flow of coolant through the electric pump 16, when the system 10 requires the electric pump 16 to be non-operational. The coolant enters the three way valve 38 from three sources. One such source is the radiator 14, wherein the three-way valve 38 receives the coolant after the heat has been dispersed. When the coolant has not reached a predetermined temperature, normally at start-up, the coolant is directed into the bypass hose 24, which feeds the water into the three-way valve 40, rather than circulating the coolant to the radiator 14 or heater cores 20. The third source is the heater cores 20, whereby the coolant leaves the heater cores and is circulated into the three-way valve 38. As illustrated in FIG. 2, the coolant enters the three-way valve 38 through one port, and exits the valve through another port and into the electric pump 16, or the coolant is directed by another port directly into the mechanical pump 18, bypassing the electric pump 16. The three-way valve 38 may be mechanical, electronic, or a cartridge heater.

Figure 3:
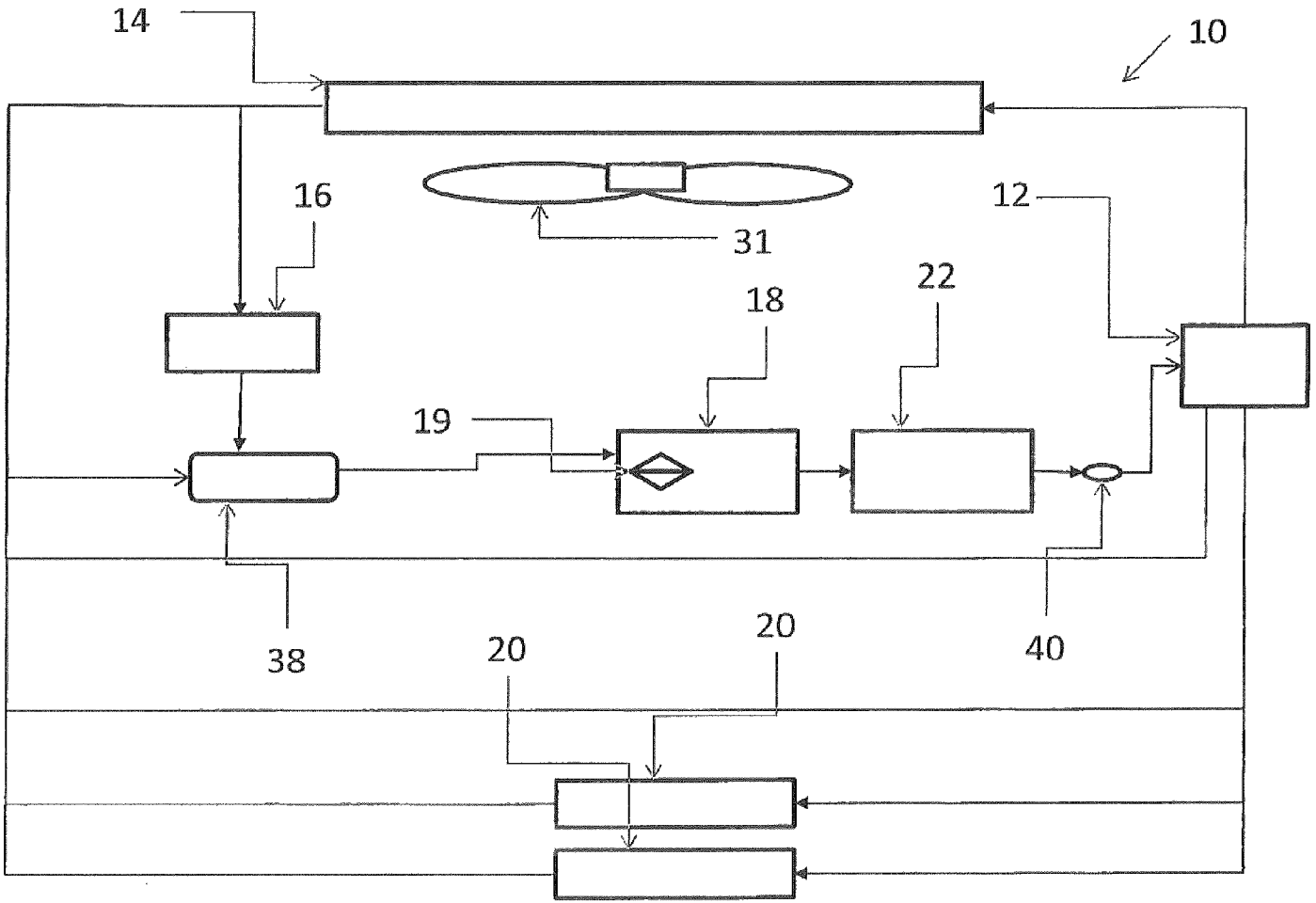
FIG. 3 is a schematic diagram of the cooling system of yet another preferred embodiment of the invention.

As illustrated in FIGS. 1, 2, and 3 an engine coolant temperature (ECT) sensor 40 is located within the coolant passage prior to the thermostat 12. The ECT sensor 40 is positioned within the passage after the coolant leaves the engine 22 and prior the thermostat 12, so that it can detect the engine coolant temperature after the coolant leaves the engine 22. The measurement of the coolant after it leaves the engine 22 allows the ECT sensor 40 to measure the average temperature of the engine 22. The ECT sensor 40 is connected to the control module. The ECT sensor 40 serves a very critical purpose to many of the functions performed by the control module, such as fuel injection, climate control, ignition timing, variable valve timing, supplemental restraint system, transmission shifting and the like. The ECT sensor 40 is a variable resistance thermistor that changes resistance as the coolant temperature from the engine 22 changes, meaning it has a negative temperature coefficient that allows less electricity to pass through the ECT sensor 40 the warmer it gets. The ECT sensor 40 is preferably constructed of a solid state material, and provides for more control over engine performance throughout the entire range of engine operation.

Optionally as shown in FIG. 2, the system 10 may consist of more than one heater core 20. As illustrated in FIG. 2, the system 10 incorporates the use of a first and second heater core 20. The first heater core 20 is designed to provide heat to the front of the passenger compartment, and the second heater core 20 is designed to provide heat to the rear of the passenger compartment. Two separate heater cores 20 allow the occupants in the front seat and rear seat of a vehicle to operate the flow of heat independently of one another. This is particularly useful in sport utility vehicles, or other similarly sized vehicles that are able to transport a large number of individuals and have a large passenger compartment. As shown in FIG. 2, the heater control valve 34 is positioned in the heater core supply hose 28 before the heater cores 20, preventing coolant from entering the heater cores 20. The heater control valve 34 controls the flow of coolant into the heater cores 20, allowing the coolant to circulate through the heater cores 20. In a closed position, the heater control valve 34 allows no flow of coolant to the heater cores 20. The lack of flow to the heater cores 20 keeps the heater cores 20 cool, when heat is not desired in the passenger compartment. On the other hand, when the heater control valve 34 is in the open position, heated coolant is allowed to circulate through the heater cores 20.

In another embodiment of the present invention and as illustrated in FIG. 3, the system 10 consists of an electric fan 31 positioned behind the radiator 14 near the engine 22, without the mechanical fan 30. The mechanical pump 18 still comprises the clutch 19, but the clutch 19 only controls the impeller of the mechanical pump 18. The electric fan 31 solely assists with the flow of air through the radiator 14. The electric pump 16 receives the coolant directly from the radiator 14. The electric pump 16 pumps the coolant to the three way valve 40, which in turn directs the coolant to the mechanical pump 18. Alternatively, the three-way valve 40 may receive the coolant directly from the radiator 14, bypassing the electric pump 16, and pumping the coolant directly to the mechanical pump 18. The three-way valve 40 may also receive the coolant from the heater cores 20, if the heater cores 20 are selectively operated. The engagement illustrated in FIG. 3 minimizes the parasitic loss of the system and improves the total fuel efficiency of the vehicle.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

What is claimed is:

1. A cooling system for an internal combustion engine of a motor vehicle having a rotating member and using coolant in a liquid cooling system, comprising: a radiator for dissipating the heat from the coolant; an electric pump for pumping the coolant through the cooling system; a mechanical pump operatively connected to the rotating member for pumping coolant through the cooling system; a clutch that engages the mechanical pump and that fully disengages the mechanical pump, both the electric and mechanical pumps pumping coolant through the cooling system when the clutch engages the mechanical pump, only the electric pump pumping coolant through the cooling system when the clutch fully disengages the mechanical pump to minimize the parasitic loss of the system; and a mechanical fan that draws air through the radiator to remove heat from the coolant, the mechanical fan being operatively connected to the mechanical pump, the mechanical fan being engaged and disengaged by the clutch; and an electric fan that transfers air through the same radiator for transferring the heat from the coolant to the air.

2. The cooling system of claim 1, further comprising a thermostat that controls the flow of coolant through the system.

3. The cooling system of claim 1, further comprising the mechanical pump in series with the electric pump such that all flow of the coolant into one of the mechanical and electric pumps is received only from the other of the mechanical and electric pumps.

4. The cooling system of claim 1, further comprising a check valve for directing the flow of coolant in the system.

5. A cooling system for an internal combustion engine of a motor vehicle having a rotating member and using a coolant in a liquid cooling system, comprising:

a radiator for dissipating the heat from the coolant; an electric fan that transfers air through the radiator for transferring the heat from the coolant to the air; an electric pump for pumping the coolant through the cooling system; a mechanical pump in series with the electric pump such that all flow of the coolant into one of the mechanical and electric pumps is received only from the other of the mechanical and electric pumps, wherein the mechanical pump is rotatably engaged to the rotating member for pumping the coolant through the cooling system; clutch that engages the mechanical pump and that fully disengages the mechanical pump, both the electric and mechanical pumps pumping coolant through the cooling system when the clutch engages the mechanical pump, only the electric pump pumping coolant through the cooling system when the clutch fully disengages the mechanical pump, thus minimizing parasitic loss of the system and improving total fuel efficiency of the vehicle; and a mechanical fan that draws air through the same radiator to remove heat from the coolant, the mechanical fan being operably connected to the mechanical pump, the mechanical fan being engaged and disengaged by the clutch.

6. The cooling system of claim 5, further comprising a thermostat for controlling the flow of coolant through the system.

7. The cooling system of claim 5, further comprising at least one heater core for selectively providing heat to a passenger compartment.

8. The cooling system of claim 5, further comprising an engine coolant temperature sensor positioned within a coolant hose after the engine and prior to an area where the coolant enters the thermostat for measuring the average temperature of the engine.

9. The cooling system of claim 5, further comprising a three way valve for directing the flow of coolant through the system.

10. A cooling system for an internal combustion engine having a rotating member and using a coolant in a liquid cooling system, comprising:

a radiator for dissipating the heat from the coolant;

an electric fan that transfers air through the radiator for transferring the heat from the coolant to the air;

an electric pump for pumping coolant through the cooling system;

a mechanical pump in series with the electric pump such that all flow of the coolant into one of the mechanical and electric pumps is received only from the other of the mechanical and electric pumps, wherein the mechanical pump is rotatably engaged to the rotating member that drives the mechanical pump and pumps coolant through the cooling system;

a clutch that engages the mechanical pump and that fully disengages the mechanical pump, both the electric and mechanical pumps pumping coolant through the cooling system when the clutch engages the mechanical pump, only the electric pump pumping coolant through the cooling system when the clutch fully disengages the mechanical pump, thus minimizing the parasitic loss of the system and improving total fuel efficiency of the vehicle;

a three way valve for directing the flow of coolant through the cooling system; and a mechanical fan that is operatively connected to the mechanical pump to move air through the radiator to remove heat from the coolant.

11. The cooling system of claim 10, further comprising a thermostat that controls the flow of coolant through the system.

12. The cooling system of claim 11, further comprising an engine coolant temperature sensor positioned within a coolant hose after the engine and prior to the area where the coolant enters the thermostat for measuring the average temperature of the engine.

13. The cooling system of claim 10 further comprising at least one heater core for selectively providing heat to a passenger compartment.

14. The cooling system of claim 10, further comprising a heater control valve for controlling the flow of coolant.

15. The cooling system of claim 10, further comprising the electric pump positioned behind the radiator near the engine.

16. The cooling system of claim 1:

wherein, upon startup of the engine, neither the electric pump nor the mechanical pump operate to pump the coolant, wherein, upon warmup of the engine, the electric pump operates to pump the coolant and the mechanical pump does not operate to pump the coolant, and wherein, upon the coolant reaching a predetermined temperature, each of the electric pump and the mechanical pump operate to pump the coolant.

17. The cooling system of claim 5:

wherein, upon startup of the engine, neither the electric pump nor the mechanical pump operate to pump the coolant, wherein, upon warmup of the engine, the electric pump operates to pump the coolant and the mechanical pump does not operate to pump the coolant, and wherein, upon the coolant reaching a predetermined temperature, each of the electric pump and the mechanical pump operate to pump the coolant.

18. The cooling system of claim 10:

wherein, upon startup of the engine, neither the electric pump nor the mechanical pump operate to pump the coolant, wherein, upon warmup of the engine, the electric pump operates to pump the coolant and the mechanical pump does not operate to pump the coolant, and wherein, upon the coolant reaching a predetermined temperature, each of the electric pump and the mechanical pump operate to pump the coolant.

* * * * *